US010500469B1

(12) United States Patent
Baron

(10) Patent No.: US 10,500,469 B1
(45) Date of Patent: Dec. 10, 2019

(54) GOLF TRAINING AID AND METHOD FOR USE

(71) Applicant: Peter C. Baron, Fullerton, CA (US)

(72) Inventor: Peter C. Baron, Fullerton, CA (US)

( * ) Notice: Subject to any disclaimer, the term of this patent is extended or adjusted under 35 U.S.C. 154(b) by 0 days.

(21) Appl. No.: 16/032,032

(22) Filed: Jul. 10, 2018

Related U.S. Application Data

(60) Provisional application No. 62/575,845, filed on Oct. 23, 2017.

(51) Int. Cl.
*A63B 69/36* (2006.01)
*A63B 102/32* (2015.01)

(52) U.S. Cl.
CPC ..... *A63B 69/3632* (2013.01); *A63B 2102/32* (2015.10)

(58) Field of Classification Search
CPC . A63B 2225/09; A63B 69/36; A63B 69/3632; A63B 69/3685; A63B 2208/0204; A63B 69/3676; A63B 2053/0433; A63B 53/02; A63B 69/3644; A63B 53/04; A63B 53/0487; A63B 69/3623; A63B 60/42; A63B 69/3608; A63B 60/00; A63B 69/0057; A63B 2022/0092; A63B 2102/32
USPC ..... 473/208, 212–219, 226–229, 257, 409
See application file for complete search history.

(56) References Cited

U.S. PATENT DOCUMENTS 3,400,933 A * 9/1968 Heiser ..... A63B 69/365 473/229
3,618,942 A * 11/1971 Bates ..... A63B 21/04 473/229
4,328,964 A * 5/1982 Walls ..... A63B 21/4035 473/229
5,139,264 A * 8/1992 Wootten ..... A63B 21/023 473/229
5,269,512 A * 12/1993 Crowson ..... A63B 21/153 473/229
5,492,321 A * 2/1996 Cipriano ..... A63B 69/0002 473/424
7,399,232 B1 * 7/2008 Frappier ..... A63B 21/0004 473/207
7,914,390 B2 * 3/2011 Seiter ..... A63B 21/0552 473/229
7,997,993 B1 * 8/2011 Matthews ..... A63B 21/0442 473/229
8,192,335 B2 * 6/2012 Pullaro ..... A63B 15/00 482/109
8,282,500 B1 * 10/2012 Masching ..... A63B 21/0442 473/219
9,782,655 B1 * 10/2017 Novosel, Sr. ..... A63B 69/0002

* cited by examiner

*Primary Examiner* — Nini F Legesse
(74) *Attorney, Agent, or Firm* — William A. English; Vista IP Law Group LLP

(57) ABSTRACT

A training aid device for golfers is provided that includes a shaft including a handle on a first end, a club head on a second end of the shaft, and a pull device coupled to the club head. During use, a student may be instructed to hold the handle of the shaft and position the club head at a location simulating a moment of impact with a golf ball, and the instructor may pull on the pull device to simulate centrifugal force acting on the club head the moment of impact.

18 Claims, 2 Drawing Sheets

GOLF TRAINING AID AND METHOD FOR USE

RELATED APPLICATION DATA

The present application claims benefit of provisional application Ser. No. 62/575,845, filed Oct. 23, 2017, the entire disclosure of which is expressly incorporated by reference herein.

FIELD OF THE INVENTION

The present invention relates to golf training devices and methods for using them and, more particularly, to golf clubface alignment demonstrator training aids and methods for using them.

BACKGROUND

Golf is a seemingly simple game, yet very difficult to master for some people. Many books have been written on how to swing the club, yet rarely address one of the secrets of a good swing. Specifically, while some golf books may devote a few explaining how a club is to be gripped, they don't explain why the club should be gripped in a certain way. Understanding why will not only help a student to recognize the grip's importance, but also will help to understand the importance of timing their swing well.

Accordingly, training devices that help golfers learn to hold and/or swing golf clubs would be useful.

SUMMARY

The present invention is directed to golf training devices and methods for using them and, more particularly, to golf clubface alignment demonstrator training aids and methods for using them.

The training aid described herein is a simple tool that shows the effect of the very large centrifugal force generated by a golf club at release in a properly timed swing. That force grows dramatically in the final (typically 0.1 second) pre-ball-impact stage of the swing, just before the club is fully released (that is, the club and arm become aligned). If the wrists and the arms are relaxed—as they should be—then the effect of the "jerk" generated by this force causes the wrists and the arms to lock in at an anatomically natural position, and similarly causes the arms to align. If the club is gripped properly, then the clubface will automatically align to be perpendicular to the intended line of flight. This simple phenomenon accounts for the incredible precision with which elite golfers can hit the ball to the middle of the fairway at 280 to 320+ yards, with the club head traveling 115 mph at the time just prior to impact.

Furthermore, the training aid may also demonstrate that, at release, the force pulling the club may cause the hands to tighten on the club. This tightening may lock the arm and the club shaft, and, if the club shaft is stiff, may increase the effective mass of the club head to increase the velocity of the struck ball.

In accordance with one embodiment, a training aid device for golfers is provided that includes a shaft including a handle on a first end; a club head on a second end of the shaft; and a pull device coupled to the club head.

In accordance with another embodiment, a method is provided for demonstrating a golf swing that includes providing a training aid including a golf club shaft including a handle on a first end and club head on a second end of the shaft, and a pull device coupled to the club head; instructing a student to hold the handle of the shaft and position the club head at a location simulating a moment of impact with a golf ball; and pulling on the pull device to simulate centrifugal force acting on the club head the moment of impact.

Other aspects and features of the present invention will become apparent from consideration of the following description taken in conjunction with the accompanying drawings.

BRIEF DESCRIPTION OF THE DRAWINGS

The drawings illustrate exemplary embodiments of the invention, in which.

DETAILED DESCRIPTION OF THE EXEMPLARY EMBODIMENTS

The training aid described herein may provide a method for simulating club centrifugal force during a golf club swing, and the ability of the centrifugal force to right the club face. Table 1 illustrates how the club demonstrates these effects. Cases 1, 2, and 3 simulate auto-alignment, i.e., what happens when a properly gripped club is suddenly "jerked" by centrifugal force at release; regardless of the rotation (pronation or supination) of the left arm and club before release, the clubface will be square after release. Cases 4, 5, and 6 illustrate the importance of gripping the club properly; an incorrect grip will cause the clubface to misalign as indicated in the right hand column (regardless of arm rotation prior to being "jerked."

TABLE 1

| | Before Simulated Jerk | | After Simulated Jerk | |
|---|---|---|---|---|
| | Left Arm | Club Face | Left Arm | Club Face |
| Illustrate auto-alignment #1 | normal | square | normal | square |
| Illustrate auto-alignment #2 | pronated | open | normal | square |
| Illustrate auto-alignment #3 | supinated | closed | normal | square |
| Illustrating effect of grip #1 | normal-neutral | square | normal | square |
| Illustrating effect of grip #2 | normal-strong grip | square | normal-strong grip | closed |
| Illustrating effect of grip #3 | normal-weak grip | square | normal-weak grip | open |

Figure 1:
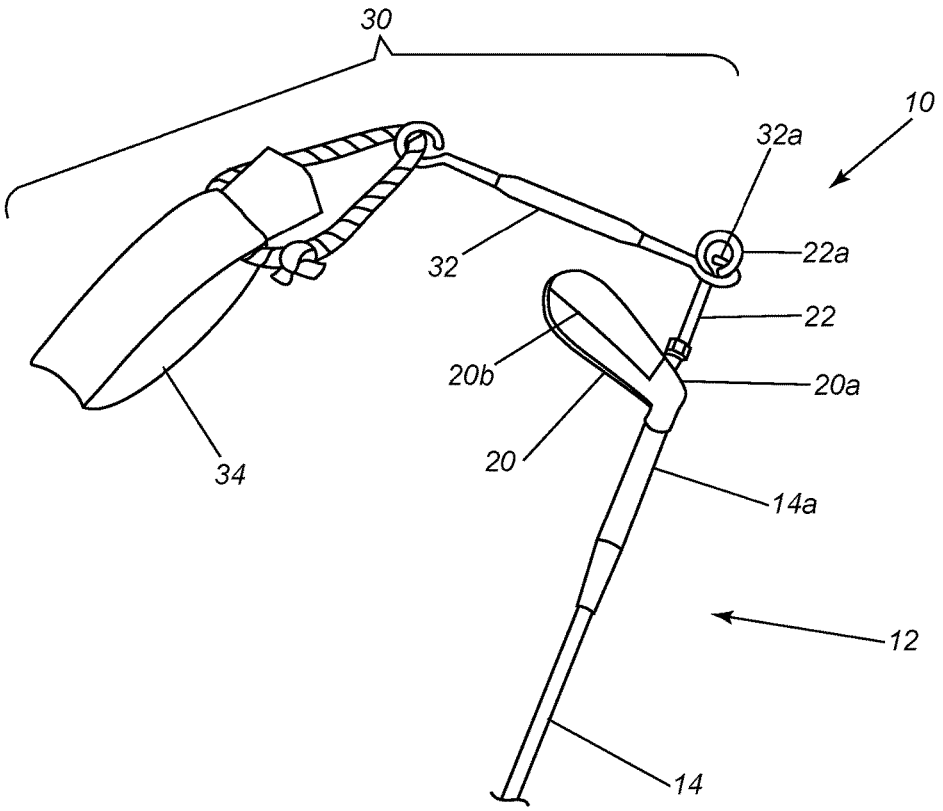
FIGS. 1 and 2 show an exemplary embodiment of a golf training aid including a golf club including a shaft and head, and a pull handle coupled to the head.
Figure 2:
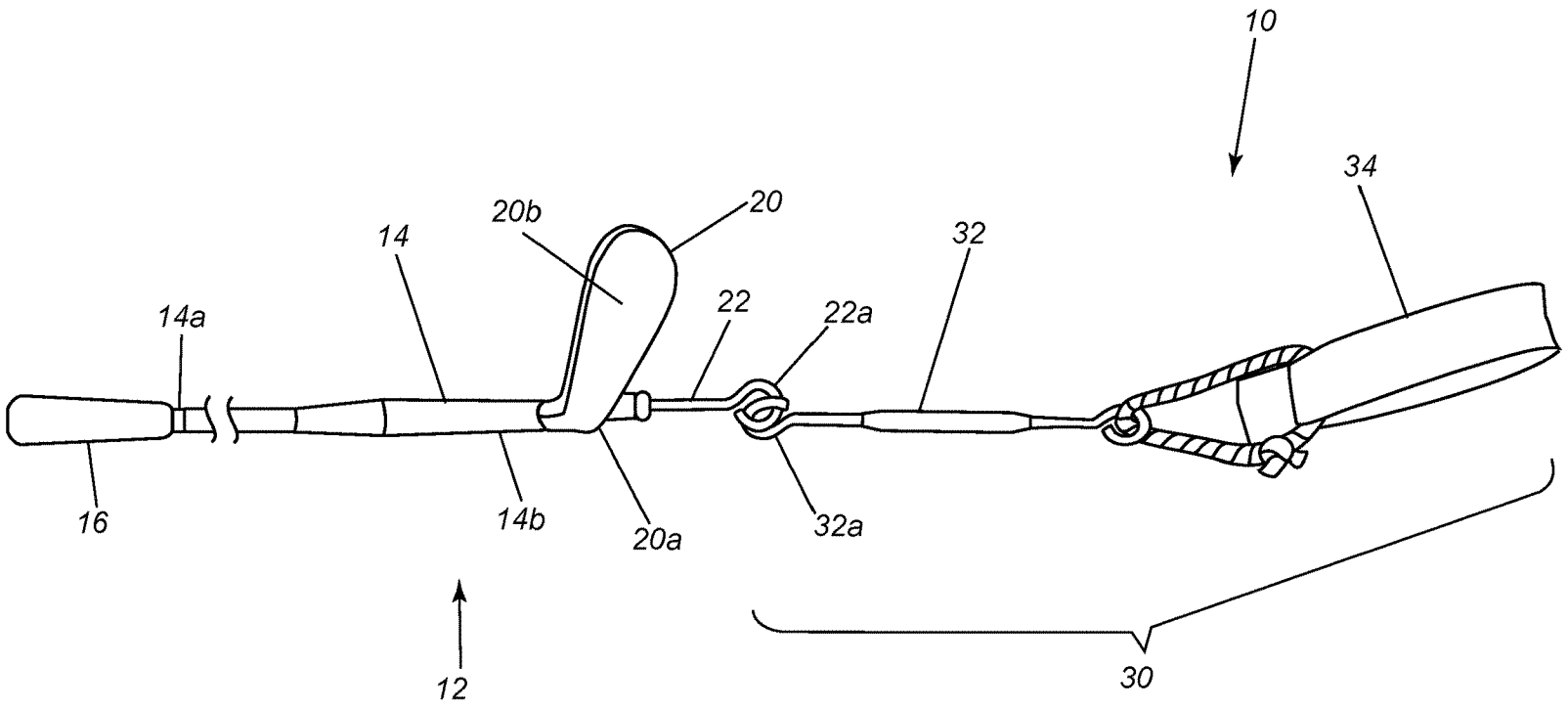

Turning to the drawings, FIGS. 1 and 2 show an exemplary embodiment of a training aid device 10 that includes two components, namely a golf club 12 and a pull device 30. The golf club 12 generally includes a shaft 14 including a first end 14*a* including a handle 16 and a second end 14*b* including a club head 20. In the example shown, the club head is an iron head, e.g., corresponding to one of a 5-iron to 8-iron, including a clubface 20*b*, although alternatively, the club head may be wood head (not shown), if desired.

A club rod or other connector member 22 is provided on the club head 20, e.g., attached to a sole and/or heel 20*a* of the head 20, for example, such that the club rod 22 is axially aligned with the shaft 14. In one embodiment, the golf club 12 may be a simulator device made specifically as a training aid, i.e., with the rod 22 integrated into the club head 20. Alternatively, the golf club 12 may be an actual golf club modified to include the connector member 22, e.g., by welding or otherwise permanently attaching the connector member 22. The connector member 22 may include a connector, e.g., a hook, eye, or ring 22*a*, on its free end such that the connector 22*a* is in-line with the shaft 14. Optionally, the connector member 22 may be adjustable relative to the club head 20. For example, a first end of the connector member 22 may include threads that are received in a corresponding threaded socket (not shown) in the club head 20 such that the length of the connector member 22 from the first end to the connector 22*a* to the free end with the connector 22*a* may be adjusted. Optionally, a threaded first end also may allow the connector member 22 to be removed entirely from the club head 20, if desired.

The pull device 30 generally includes a pull rod 32, which may be coupled to the connector member 22, and a pull handle 34, which may be coupled to the pull rod 32 such that, when the pull handle 34 is pulled, the "jerk" or other pull force is translated through the pull rod 32, the connector member 22, and head 20 to the shaft 14 of the club 12. The pull rod 32 may be a substantially rigid elongate member including a connector 32*a* on a first end, e.g., a hook, eye, or ring, corresponding to the connector 22*a* for removably or permanently connecting the pull rod 32 to the connector member 22. The connectors 22*a*, 32*a* may provide a pivoting joint that may move freely during use of the device 10.

Alternatively, the pull rod 32 may be a flexible, inelastic elongate member, e.g., a cable, chain, rope, and the like (not shown), which may allow the pull handle 34 to move relative to the club head 20 but transfer tensile forces from the handle 34 to the shaft 14. In a further alternative, the pull rod 32 may have an adjustable length, e.g., including cooperating threaded elements on the pull rod 32 or may include one or more swiveling joints (not shown), if desired.

The pull handle 34 may include a looped strap, T-handle, or other gripping device configured to receive and/or be held by an instructor's hand (or hands), and a string, rope, cable, or other flexible member connecting the gripping device to the pull rod 32. The flexible member may allow the club 12 to be swiveled without impeding alignment of the club face by a user, e.g., a golfer or student holding the club 12.

During use, an instructor may use the device to demonstrate one or more principles to a golfer/student, e.g., to demonstrate proper grip and/or swing of a golf club. Initially, the instructor may be provided with a device 10 with the club 12 and pull handle 30 separated. If so, the instructor may connect the pull handle 30 to the club 12 at any time, e.g., by hooking the connectors 22*a*, 32*a* together, before or after the student holds the handle 16.

For example, to demonstrate Cases 1, 2 and 3 in Table 1, the student may be instructed asked to grip the handle 16 of the club 12, e.g., to properly align the clubface 20*b*. He may be instructed to grip the handle 16 lightly, and to relax his arms. He may then be instructed to assume the position that he is expected to be in at impact (when the club head 20 strikes a ball). He may also be asked to brace himself against the sudden pull that will be applied.

The student may then be instructed, with his arms hanging naturally, to pronate or supinate his arms (rolling them in either direction). The instructor may then apply a sudden pull, simulating the centrifugal force of the releasing club. The student will observe that the clubface 20*b* will be properly aligned after the pull, regardless of how much the arms were rolled clockwise or counter-clockwise before the pull.

To demonstrate Cases 4, 5 and 6, the student may be instructed to hold the club 12 either correctly (Case 1) or incorrectly, using an either "strong" grip (Case 5) or "weak" grip (Case 6). After a sudden pull, he will observe that the clubface 20*b* will line up square, closed, or open for the three cases, respectively. In this manner, the instructor may help the student to better grip their clubs during actual golf swings.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the scope of the appended claims.

I claim:

1. A training aid device for golfers, comprising:
- a shaft including a handle on a first end;
- a golf head on a second end of the shaft;
- a connector rod attached at a heel of the head such that the connector rod is axially aligned with the shaft; and
- a pull device coupled to the head, wherein the pull device comprises a handle coupled to the connector rod, the handle comprising a looped strap.

2. The device of claim 1, wherein the pull device handle is coupled by a pull rod pivotally to the connector rod.

3. The device of claim 2, wherein one of the connector rod and the pull rod includes an eye and the other of the connector rod and pull rod includes a hook receivable in the eye to pivotally couple the connector rod and the pull rod together.

4. The device of claim 2, wherein the looped strap is coupled to the pull rod by a flexible member.

5. The device of claim 2, wherein the pull rod is removably coupled to the connector rod.

6. The device of claim 1, wherein the connector rod is permanently attached to the head.

7. The device of claim 1, wherein the connector rod is welded to the head.

8. The device of claim 1, wherein the connector rod is connected to the head by a threaded connection.

9. The device of claim 1, wherein the head comprises a face extending from the second end of the shaft.

10. The device of claim 1, wherein the head comprises one of an iron head or a wood head having a clubface.

11. A method for demonstrating clubface-aligning centrifugal force to ensure a square hit of a golf ball in a golf swing by an instructor, comprising:
- providing a training aid including a shaft including a handle on a first end and a head on a second end of the shaft, and a pull device coupled to the head;
- instructing a student to hold the handle of the shaft and position the head at a location simulating a moment of impact with a golf ball; and
- the instructor pulling on the pull device to simulate centrifugal force acting on the head.

12. The method of claim 11, further comprising instructing the golfer to pronate or supinate their arms immediately before pulling on the pull device.

13. The method of claim 11, wherein pulling on the pull device comprises pulling a handle of the pull device suddenly to jerk the shaft and cause the golfer's wrists and arms to lock and cause a clubface of the head to become properly aligned.

14. The method of claim 11, wherein instructing a golfer to hold the shaft handle comprises instructing the golfer to grip the shaft handle in preparation for pulling on the pull device handle.

15. The method of claim 11, further comprising connecting the pull device to the head before instructing the student to hold the shaft handle.

16. The method of claim 15, wherein the head includes a connector member aligned with the shaft, wherein the pull device includes a pull rod coupled to a handle, and wherein connecting the pull device to the head comprises connecting the pull rod to the connector member.

17. The method of claim 11, wherein the head includes a connector rod attached at a heel of the head such that the connector rod is axially aligned with the shaft, and the pull device comprises a handle that is used by the instructor to pull on the pull device.

18. A method for demonstrating a golf swing to a golfer, comprising:

providing a training aid including a shaft including a handle on a first end and a head on a second end of the shaft, and a pull device coupled to the head;

holding the handle of the shaft and position the head at a location simulating a moment of impact with a golf ball; and having an instructor pull on the pull device to simulate centrifugal force acting on the head at the moment of impact, wherein the head includes a connector rod attached at a heel of the head such that the connector rod is axially aligned with the shaft, and the pull device comprises a handle configured to be used by the instructor to pull on the pull device.

* * * * *